US008427052B2

(12) United States Patent
Van Der Burgt et al.

(10) Patent No.: US 8,427,052 B2
(45) Date of Patent: Apr. 23, 2013

(54) METAL HALIDE LAMP WITH OVERSATURATED RED

(75) Inventors: Petrus Johannes Mathijs Van Der Burgt, Eindhoven (NL); Vincent Fischer, Eindhoven (NL); Timo Borlet, Eindhoven (NL)

(73) Assignee: Koninklijke Philips Electronics N.V., Eindhoven (NL)

( * ) Notice: Subject to any disclaimer, the term of this patent is extended or adjusted under 35 U.S.C. 154(b) by 158 days.

(21) Appl. No.: 13/057,340

(22) PCT Filed: Aug. 3, 2009

(86) PCT No.: PCT/IB2009/053360

§ 371 (c)(1),
(2), (4) Date: Feb. 3, 2011

(87) PCT Pub. No.: WO2010/015988

PCT Pub. Date: Feb. 11, 2010

(65) Prior Publication Data

US 2011/0133638 A1 Jun. 9, 2011

(30) Foreign Application Priority Data

Aug. 6, 2008 (EP) ..... 08161890

(51) Int. Cl.
*H01J 11/00* (2012.01)
*H01J 17/00* (2006.01)
*H01J 17/20* (2012.01)

(52) U.S. Cl.
USPC ..... 313/567; 313/637

(58) Field of Classification Search ..... None
See application file for complete search history.

(56) References Cited

U.S. PATENT DOCUMENTS

| | | | | |
|---|---|---|---|---|
| 4,027,190 | A | 5/1977 | Shintani | |
| 4,360,758 | A | 11/1982 | Thornton | |
| 4,742,268 | A | 5/1988 | Caruso | |
| 5,256,940 | A | 10/1993 | Wada | |
| 7,180,229 | B2 | 2/2007 | Arndt | |
| 7,671,537 | B2 * | 3/2010 | Geijtenbeek et al. | 313/640 |
| 2003/0141818 | A1 | 7/2003 | Kelly | |
| 2007/0001612 | A1 | 1/2007 | Bewlay | |
| 2007/0085482 | A1 | 4/2007 | Lambrechts | |
| 2009/0121633 | A1 * | 5/2009 | Van Esveld et al. | 313/621 |
| 2009/0278457 | A1 * | 11/2009 | Fischer et al. | 313/640 |

FOREIGN PATENT DOCUMENTS

| | | | |
|---|---|---|---|
| EP | 0215524 | A1 | 5/1987 |
| EP | 0587238 | A1 | 3/1994 |
| WO | 2005088675 | A1 | 9/2005 |
| WO | 2006046175 | A2 | 5/2006 |
| WO | 2006117713 | A2 | 11/2006 |

OTHER PUBLICATIONS

Van Kemenade, J.T.C. et al Light Sources and Colour Rendering: Additional Information to the Ra Index. CIBSE National Lighting Conference, 1988.

Van Kemenada, J.T.C. et al "Towards a User Oriented Description of Colour Rendition of Light Sources" CIE Conference 2000.

* cited by examiner

*Primary Examiner* — Natalie Walford

(57) ABSTRACT

A metal halide lamp includes a ceramic discharge vessel that encloses a discharge space which accommodates two electrodes and contains a salt filling. The salt filling includes sodium iodide, thallium iodide, calcium iodide, cerium iodide, and barium iodide as a colorpoint stabilizing additive. The salt filling further includes calcium iodide and thallium iodide, and substantially no sodium iodide. The salt filling further comprises mercury iodide.

16 Claims, 4 Drawing Sheets

METAL HALIDE LAMP WITH OVERSATURATED RED

FIELD OF THE INVENTION

The present invention relates to a metal halide lamp comprising a ceramic discharge vessel enclosing a discharge space which accommodates two electrodes and contains a salt filling.

BACKGROUND OF THE INVENTION

Metal halide lamps are known in the art and are described, for example, in EP0215524, WO2006/046175, and WO05088675. Such lamps operate at a high pressure and comprise ionizable gas fillings of, for example, NaI (sodium iodide), TlI (thallium iodide), $CaI_2$ (calcium iodide), and/or $REI_n$. $REI_n$ refers to rare-earth iodides. Characteristic rare-earth iodides for metal halide lamps are $CeI_3$, $PrI_3$, $NdI_3$, $DyI_3$, and $LuI_3$. An important class of metal halide lamps includes ceramic discharge metal halide lamps (CDM-lamps), which are described in the above-mentioned documents.

EP0215524 discloses a high-pressure mercury vapor discharge lamp having a discharge vessel of gastight radiation-transmitting ceramic material, provided with a filling comprising a rare gas, mercury, sodium halide and thallium halide. The wall load has a value of at least 25 W/cm$^2$. The ratio between the effective internal diameter of the discharge vessel and the spacing between two electrodes is in a specific range.

WO2006/046175 discloses a metal halide lamp comprising a discharge vessel enclosing a discharge space containing an ionizable gas filling comprising Hg in a quantity of mass and at least a metal halide, which discharge space accommodates two electrodes whose tips have a mutual interspacing so as to define a discharge path between them, and which discharge space has a length, measured along the discharge path, and a largest diameter square thereto, wherein the ratio of the discharge space and the largest diameter is in a specific range.

WO05088675 discloses a metal halide lamp comprising a discharge vessel surrounded with clearance by an outer envelope and having a ceramic wall which encloses a discharge space filled with a filling comprising an inert gas, such as xenon (Xe), and an ionizable salt, which discharge space accommodates two electrodes whose tips have a mutual interspacing so as to define a discharge path between them, with the special feature that said ionizable salt comprises NaI, TlI, $CaI_2$ and X-iodide, wherein X is selected from the group comprising rare-earth metals. In a specific embodiment of WO05088675, X is one or more elements selected from the group comprising Ce, Pr, Nd.

U.S. Pat. No. 7,180,229 discloses a high-pressure lamp with a base and an inner vessel sealed in a vacuum-tight manner and surrounded by a sleeve part, the base having electric terminals which support the inner vessel on one side and the sleeve part on the other side, the reflector having a rotationally symmetrical design and a contour divided into at least two zonal layers, whose axial height is dimensioned in such a way that each zone captures at least 35% of the light intensity emerging from the center of the inner vessel, with a first zone reflecting back at least 90% of the light incident on it at positive angles in relation to the lamp axis, and a second zone reflecting back at least 90% of the light incident on it at negative angles in relation to the lamp axis, while the inner vessel contains a metal halide filling, and the lamp has a specified average color temperature. The lamp is a metal halide lamp for general lighting purposes, whose filling may contain halides of, inter alia, Na, Sn, Ca, Tm, Tl.

US2003141818 discloses a metal halide lamp with red emission equivalent to or exceeding that of a black body source of equal correlated color temperature. A metal halide chemistry containing $CaI_2$ plus a complexing metal halide of $AlI_3$ or $GaI_3$ is used to substantially increase the red emission of a metal halide lamp. The inclusion of TlI in the fill chemistry is also important in influencing Ca to preferably emit atomic and molecular red radiation of the visible spectrum while suppressing blue radiation. Optionally, a shroud of neodymium-doped glass is also used to significantly filter transmission of yellow light, thereby further improving the proportion of red emission while maintaining a sufficiently white color and satisfactory general color rendering.

SUMMARY OF THE INVENTION

It is desirable to provide an alternative metal halide lamp, preferably with better (photometric) properties than state-of-the-art metal halide lamps, such as those described above. In some applications, for example, for lighting fresh food products, it is desirable to provide light that yields (over)saturated product colors. Furthermore, it may be preferable that such lamps can produce (over)saturated product colors for different color types and not only for e.g. green or red. In addition, it is desirable that this color rendering is constant throughout lamp life. It is also desirable to provide a metal halide lamp which has a substantial stable color point during operation, particularly during nominal operation. It is further desirable to provide a metal halide lamp which does not substantially deteriorate with time.

According to one aspect, the invention provides a metal halide lamp comprising a ceramic discharge vessel enclosing a discharge space which accommodates two electrodes and contains a salt filling, wherein the salt filling comprises calcium iodide ($CaI_2$) and thallium iodide (TlI), and substantially no sodium iodide (NaI), and further comprises a highly volatile iodide compound (particularly $HgI_2$).

Advantageously, a lamp of this type appears to be relatively stable and may be operated at relatively high power values, at a relatively high efficiency with saturation or even oversaturation of one or more colors of products, etc. illuminated by the lamp. Surprisingly, a substantial (over)saturation of particularly the color red appears to be obtained substantially in the absence of light in the orange wavelength range, but with the availability of light in the blue, green and red ranges.

Unfortunately, the CIE 1965 color-rendering index (Ra8 orr CRI) is unable to distinguish between over and undersaturation. It is for this reason that we define R*i (wherein i=1-14) instead of Ri. For undersaturated colors, wherein R*i≦100, Ri=R*i. For oversaturated colors, Ri=200−R*i.

Here, the red rendering of a lamp is characterized by its R9 or R*9 value. It particularly appears that oversaturation values indicated by R*9 (oversaturated red rendering) of over 200, preferably over about 230 may be obtained for the lamp according to the invention. It was empirically found that R*9 does not only depend on the quantity of red but also on blue, green and particularly on the quantity of orange radiation in the spectrum:

$$R^*9=339+(-21.8^*I_{orange}+0.02^*I_{red}-1.82^*I_{blue}-0.44^*I_{green})/W$$

with: blue: 420-470 nm
green: 500-550 nm
orange: 595-605 nm (also indicated as "orange gap")
red: 610-660 nm.

The intensities in the respective spectral ranges are herein indicated in watts (W) (power integrated over the respective spectral ranges).

For substantially all colors, except yellow, the color may appear to be oversaturated, whereas in prior-art lamps, usually no or perhaps some color may be (over) saturated and/or no stable lamps (in view of lifetime and/or initial performance) and/or relatively low efficacies are obtained. As a result of the oversaturation, the color rendering Rab can drop to values as low as 60.

Particularly, the output in watts in the range of 595-605 nm, i.e. the orange range, relative to the total output in watts in the range of 400-700 nm is ≦2.5% (i.e. during nominal operation) in an embodiment. To obtain such advantageous lamps, it is preferable that the lamp substantially only comprises calcium iodide, thallium iodide and mercury iodide, optionally other iodides, but only in small quantities (if any).

As mentioned above, the salt filling preferably comprises calcium iodide ($CaI_2$) and thallium iodide (TlI), and substantially no or only a small quantity of sodium iodide (NaI), and further preferably comprises a highly volatile iodide compound (particularly $HgI_2$), i.e. a compound providing iodine in the gas phase during nominal operation. Such highly volatile compounds are mainly present in the gas phase during operation (i.e. in the form of atoms and/or ions). Volatile compounds are particularly selected from the group consisting of thallium iodide (which is preferably present per se), aluminum iodide, gallium iodide, mercury iodide, zinc iodide, tin iodide and indium iodide. Mercury iodide is preferably added as a volatile compound. Furthermore, the iodine (i.e. I, as I, $I^-$ or $I_2$) content in the gas phase during operation at nominal power (herein also referred to as "gaseous iodine content") is preferably at least 1.5 mg/mL, more preferably at least about 2.0 mg/mL. The iodine content at nominal operation is calculated as the content provided by those (volatile) compounds that assume a 100% contribution (i.e. thallium iodide, aluminum iodide, gallium iodide, mercury iodide, zinc iodide, tin iodide and indium iodide, respectively, if present). The contribution of non-volatile compounds, such as calcium iodide, cerium iodide, dysprosium iodide, lithium iodide, magnesium iodide, sodium iodide, and other alkali, alkali earth or rare-earth iodides is ignored. Of course, this is a first-order approximation. In a specific embodiment, the total gaseous iodine content in the discharge vessel during nominal operation of the lamp is therefore at least about 2.0 mg/mL.

Consequently, the lamp preferably has a relatively high iodide pressure during operation, such as in the range of 5-20 bar. This may be particularly achieved by providing mercury iodide (particularly $HgI_2$) as a salt filling component. The use of mercury iodide over other highly volatile iodides, such as gallium iodide, aluminum iodide, and tin iodide is preferred, because mercury iodide does not substantially (detrimentally) influence the spectrum of the lamp light (and thus the saturation of the colors), nor substantially influences the lifetime of the lamp. For the preferred gaseous iodine content, see also above.

As shown hereinbefore, the radiation in the orange part of the spectrum should preferably be minimized. It is therefore particularly preferred that the salt filling comprises sodium iodide in quantities which are substantially smaller than those used in prior-art lamps. This may particularly imply that the salt filling comprises sodium iodide in a quantity of about ≦2 mg/mL. However, salt fillings preferably comprise sodium iodide in a quantity of about ≦0.2 mg/mL, preferably even less. The phrase "substantially no sodium iodide" therefore indicates that the discharge vessel contains sodium iodide in a quantity of about ≦2 mg/mL, preferably less.

The salt filling preferably comprises calcium iodide in a quantity of about 6.6-33.3 mg/mL, more preferably 13.3-20 mg/mL, even more preferably 15-18 mg/mL. Furthermore, the salt filling preferably comprises thallium iodide in a quantity of about 0.3-3.33 mg/mL, more preferably about 0.8-2.7 mg/mL, even more preferably about 1-2 mg/mL. Furthermore, the salt filling may preferably comprise mercury iodide in a quantity of about 0.3-6.7 mg/mL, more preferably 1.3-3.3 mg/mL.

Further metal iodides may be added so as to tune, inter alia, the color point, for example, one or more iodides selected from the group consisting of lithium iodide (LiI), gallium iodide ($GaI_3$), aluminum iodide ($AlI_3$), indium iodide ($InI_3$), zinc iodide (particularly $ZnI_2$), and tin iodide (particularly $SnI_2$). Lithium iodide may be used to reduce green; gallium iodide may be used to provide lamps with relatively higher color temperature ("colder" light); aluminum iodide may be used, for example, to buffer impurities; indium iodide may also be used to provide lamps with relatively higher color temperature ("colder" light); zinc iodide may be used in those cases where no mercury (iodide) is desired; and tin iodide may be used to provide lamps with relatively lower color temperatures ("warmer" light).

In one embodiment, the salt filling may comprise lithium iodide in a quantity up to 1 mg/mL, preferably up to about 0.3 mg/mL. In a further embodiment, the salt filling comprises gallium iodide in a quantity up to 2 mg/mL, preferably up to about 1 mg/mL, more preferably a quantity up to about 0.3 mg/mL. In another embodiment, the salt filling comprises aluminum iodide in a quantity up to 1 mg/mL, more preferably up to about 0.3 mg/mL. However, it is preferred that the salt filling does not substantially comprise aluminum iodide, because it appears that aluminum iodide may have a detrimental effect on the lifetime of the lamp. In a further embodiment, the salt filling may comprise indium iodide in a quantity up to 1 mg/mL, preferably up to about 0.3 mg/mL. In yet a further embodiment, the salt filling may comprise zinc iodide in a quantity up to 1 mg/mL, preferably up to about 0.3 mg/mL. In a further embodiment, the salt filling may comprise tin iodide in a quantity up to 1 mg/mL, preferably up to about 0.3 mg/mL.

The salt filling preferably comprises rare-earth iodides in relatively low quantities, or more preferably substantially no rare-earth iodides. The presence of rare-earth iodides generally affects the advantages of (over)saturation of the colors, because most rare-earth iodides appear to emit light in the orange gap or otherwise influence the spectrum (detrimentally). Other iodides, including those of rare earths, such as those of one or more of metal iodides selected from the group consisting of Cs, Rb, K, Sr, Nd, Yb, La, Mg, Sc, Y, Pr, Sm, Eu, Gd, Tb, Dy, Ho, Tm, and Lu are thus preferably comprised in the salt filling in minor quantities only, or are even substantially absent. In one embodiment, the salt filling comprises one or more metal iodides selected from the group consisting of Cs, Rb, K, Sr, Nd, Yb, La, Li, Mg, Sc, Y, Pr, Sm, Eu, Gd, Tb, Dy, Ho, Tm, and Lu, particularly in a quantity smaller than 3 mg/mL, respectively. The total content of all salts other than calcium iodide, thallium iodide, aluminum iodide, gallium iodide, mercury iodide, zinc iodide, tin iodide and indium iodide is preferably smaller than about 15 mg/mL, more preferably equal to or smaller than 10 mg/mL, even more preferably equal to or smaller than about 5 mg/mL; more preferably less than about 3 mg/mL; particularly less than about 10% of the total quantity of these components.

The filling further preferably comprises mercury, i.e. the discharge vessel contains mercury in addition to the salt filling. Particularly, the discharge vessel may contain mercury in a quantity of about 8-25 mg/mL, preferably 10-20 mg/mL. This relates to mercury not bound to iodide.

In a specific embodiment, the discharge vessel contains (a) the salt filling comprising sodium iodide in a quantity of about ≦0.2 mg/mL (preferably no sodium iodide), calcium iodide in a quantity of about 13.3-20 mg/mL, thallium iodide in a quantity of about 0.8-2.7 mg/mL, mercury iodide in a quantity of about 1.3-3.3 mg/mL, one or more of aluminum iodide, lithium iodide, gallium iodide, zinc iodide, indium iodide and tin iodide in a quantity of about ≦0.3 mg/mL for each individual iodide (particularly one or more of aluminum iodide, lithium iodide, gallium iodide and tin iodide in a quantity of about ≦0.3 mg/mL for each individual iodide), substantially no other iodides, and (b) mercury in a quantity of 8-25 mg/mL.

The metal halide lamp may have a correlated color temperature in the range of about 3500-5500 K (i.e. during nominal operation). The lamp may have a relatively stable color point at nominal operation, such as a shift or modulation of the color point at nominal operation within about 10 SDCM (standard deviation of color matching), particularly within about 5 SDCM.

Such lamps further also have photometric properties that are substantially independent of their spatial orientation and/or ambient temperature.

In the art, the term "salt filling" is sometimes also indicated as "ionizable gas filling" or "ionizable salt filling".

These and other aspects of the invention are apparent from and will be elucidated with reference to the embodiments described hereinafter.

BRIEF DESCRIPTION OF THE DRAWINGS

Embodiments of the invention will now be described, by way of example only, with reference to the accompanying schematic drawings in which corresponding reference symbols indicate corresponding parts, and in which.

DESCRIPTION OF EMBODIMENTS

As mentioned above, the lamp of the invention comprises a ceramic discharge vessel. This particularly means that the walls of the ceramic discharge vessel preferably comprise a translucent crystalline metal oxide such as monocrystalline sapphire and densely sintered polycrystalline alumina (also known as PCA), YAG (yttrium aluminum garnet) and YOX (yttrium aluminum oxide), or translucent metal nitrides such as AlN. The vessel wall may consist of one or more (sintered) parts, as known in the art (see also below).

An embodiment of the lamp of the invention will now be described with reference to FIGS. 1-3. However, the lamp of the invention is not confined to the embodiments described below and/or schematically shown in FIGS. 1-3.

Lamp 1 may be a high-intensity discharge lamp. FIGS. 1-3 schematically show discharge vessels 3. Current lead-through conductors 20, 21 are sealed with two respective seals 10 (sealing fits, as known in the art). However, the invention is not limited to such embodiments. Lamps wherein one or both of the current lead-through conductors 20, 21 are, for example, directly sintered into the discharge vessel 3 may also be considered.

Figure 1:
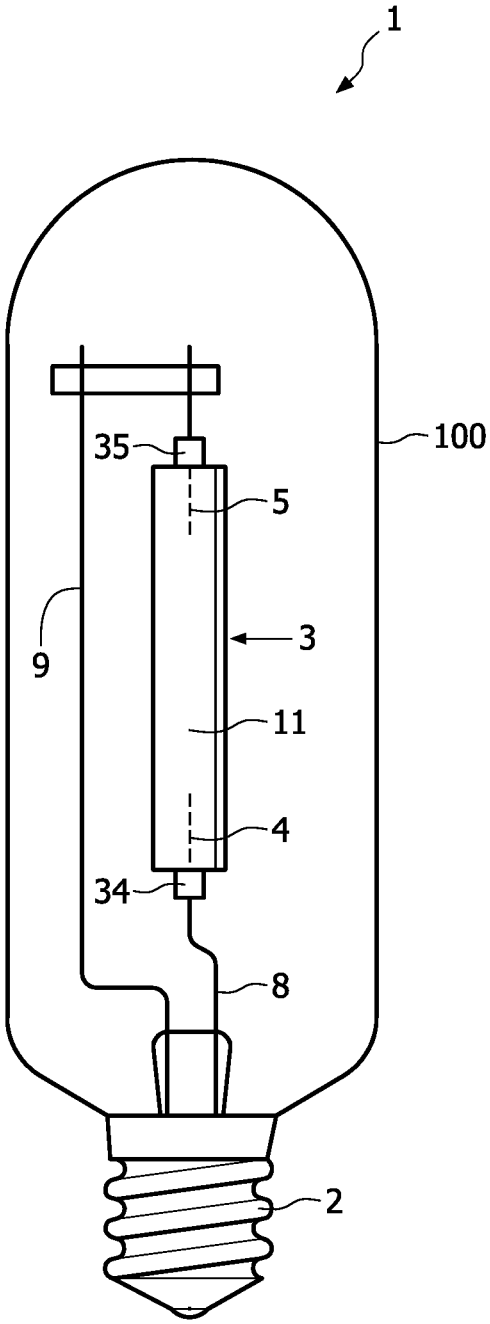
FIG. 1 schematically shows an embodiment of a lamp according to the invention in a side elevation.
Figure 2:
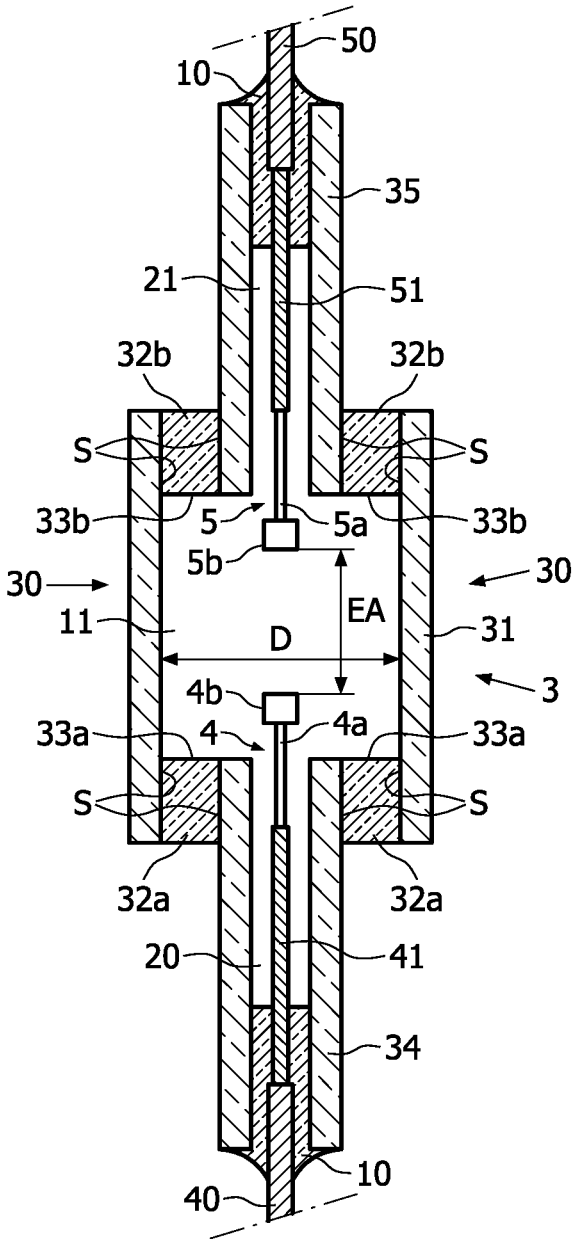
FIG. 2 schematically shows an embodiment of the discharge vessel of the lamp of FIG. 1 in more detail.
Figure 3:
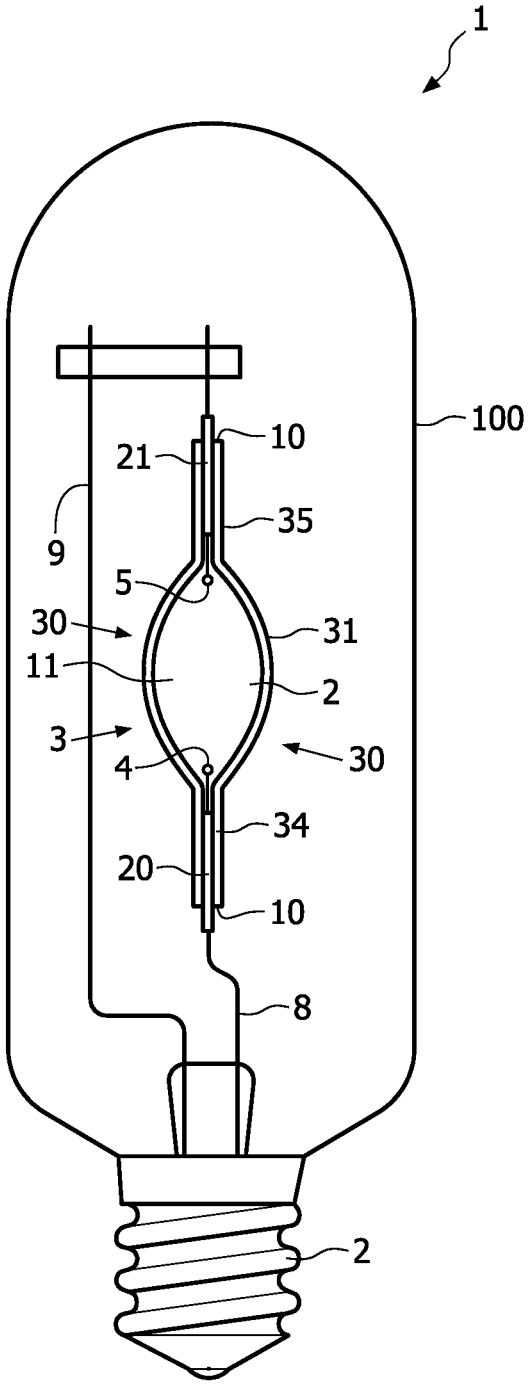
FIG. 3 schematically shows an embodiment having an alternatively shaped discharge vessel.

Specific embodiments are herein described in more detail, with both current lead-through conductors 20, 21 being secured in discharge vessel 3 by means of seals 10 (see also FIGS. 1-3). Two electrodes 4, 5, for example, tungsten electrodes, with tips 4*b*, 5*b* are arranged at a mutual distance EA in the discharge space 11 so as to define a discharge path between them. The cylindrical discharge vessel 3 has an internal diameter D at least over the distance EA. Each electrode 4, 5 extends inside the discharge vessel 3 over a length forming a tip-to-bottom distance between the wall 31 of the vessel (i.e. reference signs 33*a*, 33*b* (see also below) and the electrode tips 4*b*, 5*b*. The discharge vessel 3 may be closed at either side by means of end wall portions 32*a*, 32*b* forming end faces 33*a*, 33*b* of the discharge space. Each end wall portion 32*a*, 32*b* may have an opening in which a respective ceramic projecting plug 34, 35 fits in a gastight manner by means of a sintered joint S. The discharge vessel 3 is closed by means of these ceramic projecting plugs 34, 35, each of which encloses a current lead-through conductor 20, 21 (generally including respective components 40, 41; 50,51, which are explained in more detail below) to the electrodes 4, 5 positioned in the discharge vessel 3 with a narrow intervening space and is connected to this conductor in a gastight manner by means of a melting-ceramic joint 10 (further indicated as seal 10) at an end remote from the discharge space 11. Here, the wall 30 of the ceramic discharge vessel comprises wall 31, ceramic projecting plugs 34, 35, and end wall portions 32*a*,32*b*.

The discharge vessel 3 is surrounded by an outer bulb 100 which is provided with a lamp cap 2 at one end. A discharge will extend between the electrodes 4 and 5 when the lamp 1 is operating. The electrode 4 is connected via a current conductor 8 to a first electric contact forming part of the lamp cap 2. The electrode 5 is connected via a current conductor 9 to a second electric contact forming part of the lamp cap 2.

Each ceramic projecting plug 34, 35 narrowly encloses a current lead-through conductor 20, 21 of a relevant electrode 4, 5 having electrode rods 4*a*, 5*a* which are provided with tips 4*b*, 5*b*, respectively. Current lead-through conductors 20, 21 enter discharge vessel 3. In one embodiment, each current lead-through conductor 20, 21 may comprise a halide-resistant portion 41, 51, for example, in the form of a Mo—$Al_2O_3$ cermet, and a portion 40, 50 which is fastened to a respective end plug 34, 35 in a gastight manner by means of seals 10. Seals 10 extend through some distance, for example, approximately 1-5 mm, over the Mo cermets 41, 51 (during sealing, ceramic sealing material penetrates the free space within the respective end plugs 34, 35). Parts 41, 51 may be formed in an alternative manner instead of from a Mo—$Al_2O_3$ cermet. Other possible constructions are known, for example, from EP0587238 (herein incorporated by reference, wherein a Mo coil-to-rod configuration is described). A particularly suitable construction was found to be a halide-resistant material. Parts 40, 50 are made from a metal whose coefficient of expansion corresponds very well to that of the end plugs 34, 35. Niobium (Nb) is chosen, for example, because this material has a coefficient of thermal expansion corresponding to that of the ceramic discharge vessel 3.

FIG. 3 shows another embodiment of the lamp according to the invention. Lamp parts corresponding to those shown in FIGS. 1 and 2 are denoted by the same reference numerals. The discharge vessel 3 has a shaped wall 30 enclosing the discharge space 11. The shaped wall 30 forms an ellipsoid in the embodiment shown here. Compared with the embodiment described above (see also FIG. 2), the wall 30 is a single entity, in fact comprising wall 31, respective end plugs 34, 35, and end wall portions 32*a*, 32*b* (shown as separate parts in FIG. 2). A specific embodiment of such a discharge vessel 3 is described in more detail in WO06/046175. Alternatively, other shapes, such as, for example, spheroid are equally possible.

Wall 30, which in the embodiment schematically shown in FIG. 2 may include ceramic projecting plugs 34, 35, end wall portions 32*a*, 32*b*, and wall 31, or wall 30 (as schematically shown in FIG. 3) is a ceramic wall here, which is to be understood to mean a wall of translucent crystalline metal oxide or translucent metal nitrides such as AN (see also above). According to the state of the art, these ceramics are well suited to form translucent walls of the discharge vessel 3. Such translucent ceramic discharge vessels 3 are known; see, for example, EP215524, EP587238, WO05/088675, and WO06/046175. In a specific embodiment, the discharge vessel 3 comprises translucent sintered $Al_2O_3$, i.e. wall 30 comprises translucent sintered $Al_2O_3$. In the embodiment schematically shown in the Figures, wall 30 may also comprise sapphire.

The filling in the lamp 1 of the invention may comprise $CaI_2$ TlI and preferably $HgI_2$. Furthermore, the discharge space 11 preferably contains Hg (mercury) and a starter gas such as Ar (argon) or Xe (xenon), as known in the art. Characteristic Hg quantities are between about 1 and 100 mg/mL Hg, particularly in the range of about 8-25 mg/mL Hg; characteristic pressures are in the range of about 2-50 bar. The quantity of mercury in the discharge vessel 3 is preferably chosen to provide a mercury gas at nominal use without condensation of mercury, i.e. the mercury vapor is unsaturated. In principle, the lamp of the invention may also be operated free of mercury, but Hg is present in the discharge vessel 3 in the preferred embodiments. During steady-state burning (herein also referred to as nominal operation), long-arc lamps generally have a pressure of a few bar, whereas short-arc lamps may have pressures of up to about 50 bar in the discharge vessel. Characteristic power values of the lamp are between about 10 and 1000 W, preferably in the range of about 20-600 W.

Nominal operation in this description is understood to mean operation at the maximum power and under conditions for which the lamp has been designed to be operated.

Characteristic volumes of the discharge vessel are in the range of about 0.03-3 mL.

The discharge vessel 3 is filled with the filling (i.e. starter gas, salt filling and Hg) by means of techniques known in the art. During (nominal) use, the salts dissociate into iodine and metal elements and ions.

The contents of a filling can be estimated by means of methods known in the art, such as, inter alia, AAS, iodometry, ion chromatography. In general, such methods evaluate the metal and iodine content. The moles of metals as well as those of iodine can be calculated from these quantities. Knowing the chemical formulas (here assuming $CaI_2$, TlI, and, if available, one or more of $AlI_3$, $GaI_3$, LiI, NaI, $SnI_2$, etc.) the iodine moles are attributed to corresponding metals; the remaining iodine is attributed to mercury. For example, assuming 1 mole Ca, 1 mole Tl, 1 mole Hg, 0.1 mole Ga and 3.7 mole I, the filling appears to comprise 1 mole $CaI_2$, 1 mole TlI, 0.1 mole $GaI_3$, 0.2 mole $HgI_2$, and 0.8 mole Hg.

Optionally, one or more other iodides, as described herein, may additionally be present in the discharge vessel 3 (see also above).

EXAMPLES

Example of Lamp/Discharge Vessel According to the Invention

A lamp 1 with discharge vessel 3 having a volume of about 0.3 $cm^3$ was made (see Tables). The discharge vessel 3 contained the following filling as indicated in Tables 1-3 and about 300 mbar Ar. The lamps were operated at 230 V, 50 Hz, in a room temperature environment.

Relevant properties are indicated in Tables 1-3. R*9 values in these Tables are values derived from optical measurements.

TABLE 1

| | Examples | | | | | | | | | |
|---|---|---|---|---|---|---|---|---|---|---|
| | A | B | C | D | G | H | I | J | K | L |
| | Fill | | | | | | | | | |
| | Na—Tl—Ca—Ce | White SON | Al—Tl—Ca | Al—Tl—Ca | Ca—Tl—$HgI_2$ | Al—Tl—Ca—Li | Al—Mg—Ca | Ca—Tl—Sn | Ca—Tl—Ga | Al—Tl—Ca—Dy—Na |
| Volume (mL) | 0.3 | | 0.3 | 0.3 | 0.3 | 0.3 | 0.3 | 0.3 | 0.27 | 0.3 |
| $CaI_2$ (mg/mL) | 28.8 | | 3.5 | 15.4 | 16.5 | 3.5 | 17.6 | 15.8 | 21.1 | 4.1 |
| TlI (mg/mL) | 1.3 | | 1.3 | 1.4 | 1.5 | 0.9 | | 2.3 | 2.1 | 0.9 |
| $AlI_3$ (mg/mL) | | | 1.6 | 1.3 | | 1.9 | 2.3 | | | 1.3 |
| $CeI_3$ (mg/mL) | 0.9 | | | | | | | | | |
| $DyI_3$ (mg/mL) | | | | | | | | | | 1.0 |
| $GaI_3$ (mg/mL) | | | | | | | | | 1.8 | |
| Hg (mg/mL) | 16.3 | | 13.5 | 13.5 | 13.3 | 14.0 | 14.3 | 13.7 | 20.6 | 13.4 |
| $HgI_2$ (mg/mL) | | | | | 2.9 | | | | | |
| LiI (mg/mL) | | | | | | 0.6 | | | 0.1 | |
| $MgI_2$ (mg/mL) | | | | | | | 6.4 | | | |
| NaI (mg/mL) | 4.9 | | | | | | | | | 0.7 |
| $SnI_2$ (mg/mL) | | | | | | | | 1.7 | | |
| 420-470 nm | 15.6 | 11.3 | 16.9 | 16.2 | 16.2 | 16.9 | 21.5 | 11.4 | 22.8 | 17.3 |
| 500-550 nm | 28.7 | 16.6 | 31.0 | 27.8 | 30.9 | 29.8 | 23.5 | 32.8 | 32.7 | 28.6 |
| 595-605 nm | 11.6 | 2.0 | 2.6 | 2.4 | 2.1 | 2.5 | 3.1 | 3.7 | 2.2 | 9.5 |
| 610-660 nm | 44.1 | 70.1 | 49.5 | 53.6 | 50.8 | 50.8 | 51.8 | 52.1 | 42.3 | 44.6 |
| Voltage (V) | 81.2 | 109.0 | 99.5 | 76.4 | 93.2 | 101.2 | 100.4 | 87.4 | 98.3 | 110.2 |
| power (W) | 72.5 | 95.7 | 72.2 | 75.4 | 72.6 | 72.2 | 72.8 | 72.6 | 72.8 | 72.2 |

TABLE 1-continued

| | Examples | | | | | | | | | |
|---|---|---|---|---|---|---|---|---|---|---|
| | A | B | C | D | G | H | I | J | K | L |
| | Fill | | | | | | | | | |
| | Na—Tl—Ca—Ce | White SON | Al—Tl—Ca | Al—Tl—Ca | Ca—Tl—$HgJ_2$ | Al—Tl—Ca—Li | Al—Mg—Ca | Ca—Tl—Sn | Ca—Tl—Ga | Al—Tl—Ca—Dy—Na |
| Lumen (lm) | 7556 | 4860 | 6052 | 5652 | 5857 | 5730 | 4287 | 5053 | 4822 | 7057 |
| efficacy (lm/W) | 104.2 | 50.8 | 83.9 | 74.9 | 80.7 | 79.4 | 58.9 | 69.6 | 66.2 | 97.7 |
| X | 0.428 | 0.457 | 0.388 | 0.398 | 0.389 | 0.399 | 0.386 | 0.412 | 0.350 | 0.415 |
| Y | 0.394 | 0.404 | 0.385 | 0.376 | 0.390 | 0.379 | 0.330 | 0.422 | 0.362 | 0.382 |
| CCT (K) | 3078 | 2690 | 3867 | 3545 | 3885 | 3537 | 3383 | 3604 | 4865 | 3215 |
| Ra8 | 89.8 | 82.1 | 66.7 | 60.1 | 61.6 | 64.7 | 53.1 | 72.3 | 64.3 | 93.5 |
| R9 | 73.2 | 13.4 | −36.3 | −66.3 | −56.7 | −34.1 | −83 | −4.9 | −55.3 | 93.7 |
| R*9 | 73.2 | 186.6 | 236.3 | 266.3 | 256.7 | 234.1 | 283 | 204.9 | 255.3 | 93.7 |
| total free I in gas | 0.50 | 0.00 | 2.04 | 1.72 | 2.18 | 2.09 | | | | 1.57 |

Example A relates to the currently available prior-art lamps and Example B relates to the currently available ultrahigh-pressure sodium discharge lamps. Example C relates to a lamp conforming to US20030141818 A1 and showed strong deterioration of color rendering. When much higher quantities of Ca were added, the lamp improved, but was still not stable (example D) in terms of lifetime. Example G is an example of a particularly preferred lamp with a high efficacy and a high R*9. Example H shows that y decreases slightly and x increases slightly with some Li. Mg replacement of Tl, at least in this quantity, results in a lamp with a color point substantially below BBL (black body locus) having a relatively low efficacy. Example J shows that Sn can be used to reduce CCT, and example K shows that Ga can be used to increase CCT. Example L shows that addition of Na and Dy improves the color rendering Ra, but as expected, R*9 substantially decreases (to slight undersaturation R*9; saturation implies R*9=100; undersaturation implies R*9<100 and oversaturation implies R*9>100). Tables 2 and 3 give some more examples.

TABLE 2

| | Fill | | | | | | | |
|---|---|---|---|---|---|---|---|---|
| | Ca—Tl—Ga | Ca—Tl—Ga | Ca—Tl—Ga | Ca—Tl—Al | Ca—Tl—Ga—Li | Ca—Tl—Al | Ca—Tl—Ga | Ca—Tl—Sn |
| Volume (mL) | 0.31 | 0.31 | 0.31 | 0.3 | 0.27 | 0.27 | 0.3 | 0.27 |
| $CaI_2$ (mg/mL) | 11.71 | 18.90 | 10.81 | 18.90 | 21.07 | 21.63 | 16.75 | 20.52 |
| TlI (mg/mL) | 3.03 | 1.94 | 2.13 | 2.50 | 2.07 | 2.28 | 1.64 | 1.70 |
| $AlI_3$ (mg/mL) | | | | 2.50 | | 2.28 | | |
| $CeI_3$ (mg/mL) | | | | | | | | |
| $DyI_3$ (mg/mL) | | | | | | | | |
| $GaI_3$ (mg/mL) | 1.77 | 1.35 | 1.90 | | 1.83 | | 1.76 | |
| Hg (mg/mL) | 13.16 | 13.03 | 12.58 | 13.63 | 20.56 | 21.63 | 13.33 | 20.59 |
| $HgI_2$ (mg/mL) | | | | | | | | |
| LiI (mg/mL) | | | | | 0.10 | | | |
| $MgI_2$ (mg/mL) | | | | | | | | |
| NaI (mg/mL) | | | | | | | | 1.52 |
| 420-470 nm | 12.1 | 20.9 | 19.5 | 13.5 | 22.8 | 20.3 | 17.6 | 13.9 |
| 500-550 nm | 36.8 | 30.6 | 35.0 | 30.1 | 32.7 | 33.3 | 29.1 | 35.2 |
| 595-605 nm | 4.5 | 2.5 | 3.5 | 4.8 | 2.2 | 2.8 | 3.1 | 2.9 |
| 610-660 nm | 46.6 | 46.0 | 41.9 | 51.5 | 42.3 | 43.6 | 50.2 | 48.0 |
| Voltage (V) | 82.5 | 77.2 | 80.5 | 99.5 | 98.3 | 100.7 | 89.8 | 94.9 |
| Power (W) | 85.7 | 85.2 | 85.5 | 74.8 | 72.8 | 72.8 | 72.4 | 73.6 |
| Lumen (Lm) | 6087 | 6151 | 5317 | 5375 | 4822 | 4407 | 4345 | 5201 |
| Efficacy (Lm/W) | 71.1 | 72.2 | 62.2 | 71.8 | 66.2 | 60.5 | 60.1 | 70.6 |
| X | 0.377 | 0.370 | 0.364 | 0.411 | 0.350 | 0.362 | 0.354 | 0.377 |
| Y | 0.399 | 0.365 | 0.386 | 0.400 | 0.362 | 0.377 | 0.363 | 0.388 |
| CCT (K) | 4225 | 4205 | 4514 | 3462 | 4865 | 4529 | 4721 | 4170 |
| Ra8 | 75.8 | 66.5 | 77.6 | 76.7 | 64.3 | 67.6 | 59.7 | 61 |
| R9 | −3.6 | −42.7 | 8.5 | 5.7 | −55.3 | −30.5 | −64.2 | −48.7 |
| R*9 | 203.6 | 242.7 | 191.5 | 194.3 | 255.3 | 230.5 | 264.2 | 248.7 |
| total free I in gas | 2.66 | 1.88 | 2.42 | 3.29 | 2.34 | 3.00 | 2.12 | 1.69 |

TABLE 3

| | Fill | | | | | | | |
|---|---|---|---|---|---|---|---|---|
| | Ca—Tl—HgJ2 | Ca—Tl—HgJ2 | Ca—Tl—HgJ2 | Ca—Tl—HgJ2 | Ca—Tl—HgJ3—Na | Ca—Tl—HgJ2—Li | Ca—Tl—HgJ2—Sn | Ca—Tl—HgJ2 |
| Volume (mL) | 0.3 | 0.3 | 0.3 | 0.3 | 0.27 | 0.27 | 0.27 | 0.27 |
| $CaI_2$ (mg/mL) | 16.90 | 16.67 | 16.67 | 18.4 | 18 | 20.41 | 21.16 | 20.74 |

TABLE 3-continued

| | Fill | | | | | | | |
|---|---|---|---|---|---|---|---|---|
| | Ca—Tl—HgJ2 | Ca—Tl—HgJ2 | Ca—Tl—HgJ2 | Ca—Tl—HgJ2 | Ca—Tl—HgJ3—Na | Ca—Tl—HgJ2—Li | Ca—Tl—HgJ2—Sn | Ca—Tl—HgJ2 |
| TlI (mg/mL) | 2.50 | 1.33 | 1.33 | 1.2 | 0.62 | 0.94 | 0.811 | 1.47 |
| $AlI_3$ (mg/mL) | | | | | | | | |
| $CeI_3$ (mg/mL) | | | | | | | | |
| $DyI_3$ (mg/mL) | | | | | | | | |
| $GaI_3$ (mg/mL) | | | | | | | | |
| Hg (mg/mL) | 11.60 | 12.67 | 10.67 | 18.4 | 20 | 19.77 | 19.79 | 20.02 |
| $HgI_2$ (mg/mL) | 1.87 | 0.33 | 5.00 | 2.9 | 3.24 | 2.68 | 3.07 | 2.81 |
| LiI (mg/mL) | | | | | | 0.41 | | |
| $MgI_2$ (mg/mL) | | | | | 1.75 | | | |
| NaI (mg/mL) | | | | | | | 0.5 | |
| 420-470 nm | 14.5 | 21.7 | 15.7 | 18.6 | 29.5 | 19.0 | 18.9 | 19.0 |
| 500-550 nm | 31.4 | 34.4 | 25.9 | 29.3 | 16.9 | 28.1 | 27.3 | 33.1 |
| 595-605 nm | 2.1 | 1.2 | 2.4 | 1.6 | 1.6 | 1.4 | 1.8 | 1.7 |
| 610-660 nm | 52.0 | 42.6 | 55.9 | 50.5 | 52.1 | 51.5 | 52.1 | 46.2 |
| Voltage (V) | 94.7 | 86.0 | 114.7 | 99.6 | 92.7 | 103 | 103.6 | 101.2 |
| Power (W) | 72.7 | 72.5 | 72.8 | 85.1 | 85 | 85.2 | 85.4 | 85 |
| Lumen (Lm) | 5821 | 6119 | 4284 | 5895 | 4514 | 5273 | 5275 | 5563 |
| Efficacy (Lm/W) | 80.1 | 84.4 | 58.8 | 69.3 | 53.1 | 61.9 | 61.8 | 65.5 |
| X | 0.395 | 0.354 | 0.411 | 0.384 | 0.394 | 0.392 | 0.391 | 0.37 |
| Y | 0.400 | 0.381 | 0.373 | 0.374 | 0.298 | 0.367 | 0.365 | 0.386 |
| CCT (K) | 3811 | 4815 | 3224 | 3886 | 2778 | 3620 | 3621 | 4362 |
| Ra8 | 60.8 | 58.5 | 58.8 | 59.2 | 79.6 | 55.3 | 57.3 | 60.6 |
| R9 | −57.6 | −39.4 | −60.9 | −64.7 | 6.5 | −71.6 | −71.9 | −48.5 |
| R*9 | 257.6 | 239.4 | 260.9 | 264.7 | 193.5 | 271.6 | 271.9 | 248.5 |
| total free I in gas | 2.00 | 0.69 | 3.30 | 2.08 | 2.05 | 1.86 | 2.37 | 2.13 |

Figure 4A:
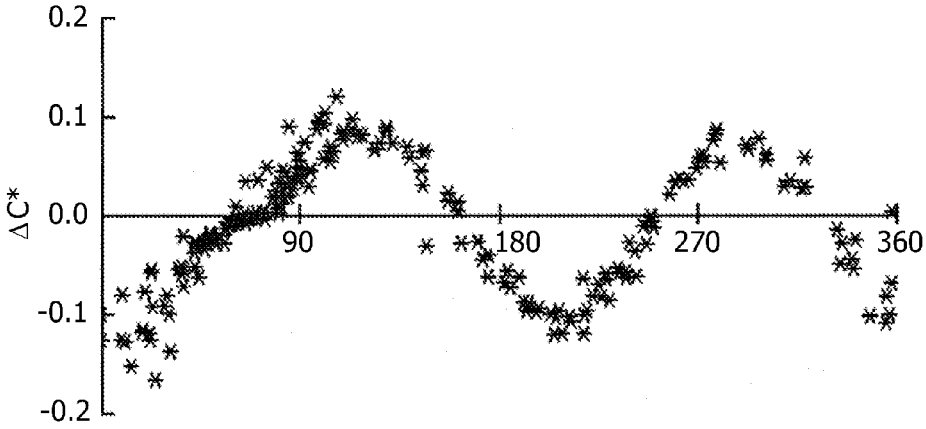
FIGS. 4*a*-4*b* show the saturation shift in terms of $\Delta C^*$ versus hue (in degrees), according to the HSL (hue, saturation, lightness) notations known in the art, of a prior-art lamp and an embodiment of the lamp according to the invention.
Figure 4B:
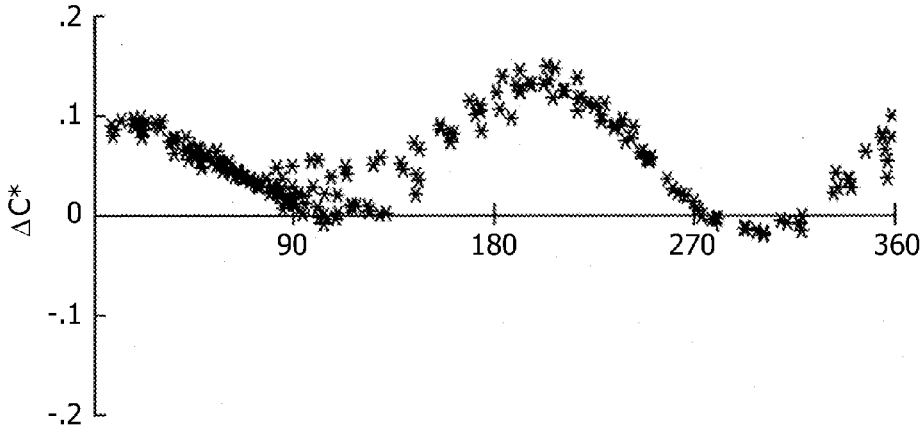

FIGS. 4*a*-4*b* show the saturation shift in terms of ΔC* versus the hue (in degrees), according to the HSL (hue, saturation, lightness) notations known in the art, of a prior-art lamp (FIG. 4*a*) and an embodiment of the lamp according to the invention (4*b*). Much better saturation is found, i.e. substantially all colors are oversaturated (ΔC*>0), except for the range between about 270°-330°, which corresponds to greenish colors. Herein, ΔC* is the reduced chroma, defined as Δchroma/chroma (wherein Δchroma=chroma (source)−chroma (reference). Further reference is made to, for example, J. T. C. van Kemenade, P. J. M. van der Burgt, in "Light sources and color rendering: Additional information to the Ra-index", CIBSE National Lighting Conference 1988 (Proceedings), and J. T. C. van Kemenade, P. J. M. van der Burgt in "Towards a user oriented description of color rendition of light sources", CIE Conference 2000 (Proceedings).

Use of the adverb "substantially" as used in this description and claims, such as in "substantially all emission" or in "substantially consists", will be understood by the person skilled in the art. "Substantially" may also include embodiments mentioning the adverbs "entirely", "completely", and the adjective or pronoun "all", etc. Hence, "substantially" may also be removed in embodiments. Where applicable, "substantially" may also relate to 90% or more, such as 95% or more, particularly 99% or more, more particularly 99.5% or more, including 100%. The verb "comprise" also includes embodiments in which it means "consists of".

The lamps mentioned hereinbefore are described, inter alia, in their state of operation. As will be clear to the person skilled in the art, the invention is not limited to methods of operation or lamps in operation.

It should be noted that the above-mentioned embodiments illustrate rather than limit the invention, and that those skilled in the art will be able to design many alternative embodiments without departing from the scope of the appended claims. In the claims, any reference signs placed between parentheses shall not be construed as limiting the claim. Use of the verb "comprise" and its conjugations does not exclude the presence of elements or steps other than those stated in a claim. The article "a" or "an" preceding an element does not exclude the presence of a plurality of such elements. In the device claim enumerating several means, several of these means may be embodied by one and the same item of hardware.

The mere fact that certain measures are recited in mutually different dependent claims does not indicate that a combination of these measures cannot be used to advantage.

The invention claimed is:

1. A metal halide lamp comprising:

a ceramic discharge vessel enclosing a discharge space;

electrodes located at least partially in the discharge space; and a salt filling in the discharge space, where the salt filling comprises calcium iodide and thallium iodide, and substantially no sodium iodide, and further comprises mercury iodide so that a saturated red rendering R*9 of light output of the lamp is at least 200.

2. The metal halide lamp according to claim 1, wherein the salt filling comprises sodium iodide in a quantity of ≦0.2 mg/mL.

3. The metal halide lamp according to claim 1, wherein the salt filling does not substantially comprise aluminum iodide.

4. The metal halide lamp according to claim 1, wherein the salt filling comprises calcium iodide in a quantity of 6.6-3.33 mg/mL.

5. The metal halide lamp according to claim 1, wherein the salt filling comprises thallium iodide in a quantity of 0.3-3.33 mg/mL.

6. The metal halide lamp according to claim 1, wherein the salt filling comprises mercury iodide in a quantity of 0.3-6.7 mg/mL.

7. The metal halide lamp according to claim 1, wherein the discharge vessel contains mercury in a quantity of 8-25 mg/mL.

8. The metal halide lamp according to claim 1, wherein the salt filling comprises lithium iodide in a quantity up to 1 mg/mL.

9. The metal halide lamp according to claim 1, wherein the salt filling comprises gallium iodide in a quantity up to 2 mg/mL.

10. The metal halide lamp according to claim 1, wherein the salt filling comprises tin iodide in a quantity up to 1 mg/mL.

11. The metal halide lamp according to claim 1, wherein the the salt filling comprises:

sodium iodide in a quantity of ≦0.2 mg/mL;

calcium iodide in a quantity of 13.3-20 mg/mL;

thallium iodide in a quantity of 0.8-2.7 mg/mL;

mercury iodide in a quantity of 1.3-3.3 mg/mL;

one or more of aluminum iodide, lithium iodide, gallium iodide and tin iodide in a quantity of ≦0.3 mg/mL for each individual iodide;

substantially no other iodides; and mercury in a quantity of 8-25 mg/mL.

12. The metal halide lamp according to claim 1, having a correlated color temperature in the range of 2500-4500 K.

13. The metal halide lamp according to claim 1, wherein the output in W in the range of 595-605 nm relative to the total output in W in the range of 400-700 nm is ≦2.5%.

14. The metal halide lamp according to claim 1, wherein a color rendering Ra8 of the light output of the lamp is 60 and higher and wherein the R*9 is defined as:

$$R^*9=339+(-21.8^*I_{orange}+0.02^*I_{red}-1.82^*I_{blue}-0.44^*I_{green})/W$$

with: blue: 420-470 nm green: 500-550 nm orange: 595-605 nm, and wherein the intensities in the respective spectral range are in W.

15. The metal halide lamp according to claim 1, wherein the total gaseous iodine content in the discharge vessel during nominal operation of the lamp is at least 2 mg/mL.

16. The metal halide lamp of claim 1, wherein a color rendering Ra8 of the light output of the lamp is in a range between 53 and 93.

* * * * *